United States Patent [19]

Crisp

[11] 3,963,357

[45] June 15, 1976

[54] APPLICATOR DEVICE

[75] Inventor: David John Crisp, London, England

[73] Assignee: Beecham Group Limited, Great Britain

[22] Filed: July 25, 1974

[21] Appl. No.: 491,879

[30] Foreign Application Priority Data

Aug. 2, 1973 United Kingdom ..... 36864/73

[52] U.S. Cl. ..... 401/191; 222/191

[51] Int. Cl.[2] ..... A46B 11/02

[58] Field of Search ..... 222/92, 106, 107, 192, 222/533, 536, 402.15; 401/139, 191, 261–266

[56] References Cited

UNITED STATES PATENTS

| | | | |
|---|---|---|---|
| 427,897 | 5/1890 | Palson | 222/92 |
| 2,710,709 | 6/1955 | Bowers | 222/192 |
| 2,772,432 | 12/1956 | Andreola | 222/536 X |
| 3,192,555 | 7/1965 | Nyden | 222/192 X |
| 3,478,938 | 11/1969 | Krause | 222/402.15 X |
| 3,682,557 | 8/1972 | Simon et al. | 401/139 |

FOREIGN PATENTS OR APPLICATIONS

| | | | |
|---|---|---|---|
| 168,299 | 5/1951 | Germany | 222/92 |

*Primary Examiner*—Stanley H. Tollberg
*Assistant Examiner*—Charles A. Marmor

[57] ABSTRACT

An applicator which is particularly useful for viscous fluids such as adhesives is constructed which comprises a reservoir body which holds the viscous liquid, a discharge nozzle which communicates with the reservoir body, a spreading member which is constructed in a manner suitable for spreading the viscous liquid from the reservoir over the desired surface, and a hinge for positioning the spreading member so that it can be moved between a position which is adjacent to the discharge nozzle and a position remote from the discharge nozzle.

8 Claims, 4 Drawing Figures

APPLICATOR DEVICE

This invention relates to a device for dispensing or applying viscous fluids, and in particular, to a device for the application of adhesive from tubes onto substrates.

When adhesives are applied to substantially flat surfaces from a flexible tube a more even application of film may be achieved by using a flat or grooved edge of an implement to spread the adhesive. Such a spreading implement may be used separately from the nozzle of the tube directly onto a surface to be bonded, but devices are also known which fit over the nozzle so that the adhesive is extruded through an aperture in the spreading device and applied to the surface with the edge of the device.

However, if it is required to apply adhesive directly from the nozzle, as a fine point application, for example for model making or repairing crockery the above described device must first be removed, for example by unscrewing, from the tube. It is an object of this invention to provide a device which has an adjustable spreader member so that it may be positioned either adjacent the nozzle, to assist in the application of viscous fluids such as adhesives, to flat surfaces, or away from the end of the nozzle to permit point application.

The present invention provides an applicator device for viscous fluids such as adhesives, comprising a reservoir body for holding viscous fluids, a discharge nozzle communicating with the interior of the reservoir body and a spreading member having an edge adapted to spread viscous fluid over a surface, the spreading member being provided with position adjusting means permitting it to be moved between a position adjacent the discharge nozzle and a position remote from the nozzle.

One embodiment of this invention will now be described with reference to the accompanying drawings wherein.

Figure 1:
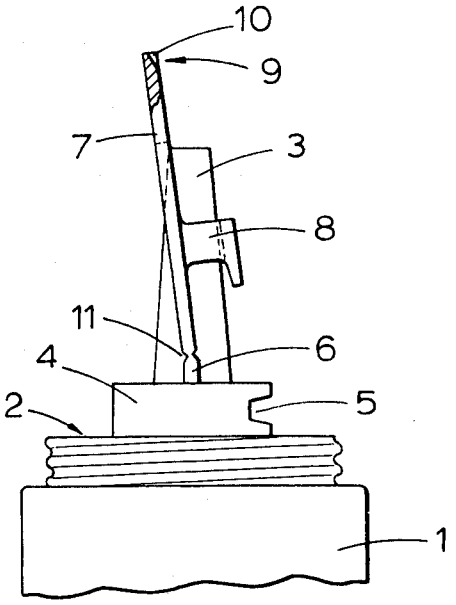
FIG. 1 represents a side elevation of an applicator device in accordance with this invention position for viscous fluid application to substantially flat surfaces.
Figure 2:
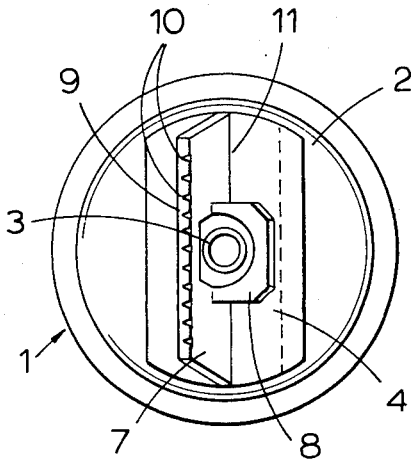
FIG. 2 represents a plan view of the device as shown in FIG. 1.

Referring to FIGS. 1 and 2, a reservoir body 1, for example a collapsable metal or plastic tube, has a top portion 2 and a discharge nozzle 3 mounted on or integral with the top portion 2 and communicating with the interior of the reservoir body. A collar 4 (e.g. of plastic material) is fixed around the base of the nozzle 3 and has a recess 5. The collar 4 is integral with (or has mounted on it) a support 6. The support 6 carries a spreading member in the form of a spatulate flange (e.g. of plastic) 7 which has an edge 9 provided with a number of grooves 10. The flange 7 is shaped with a cut-out center portion so that it fits over the nozzle 3 and carries a clamp 8. Position adjusting means for allowing the flange 7 to be moved between a position adjacent the nozzle and a position remote from the nozzle is provided by hinge 11.

In the position depicted in FIGS. 1 and 2, the flange 7 is fitted over the end of the nozzle 3 and held in place by means of the clamp 8 which clips around the nozzle.

In operation, pressure on the tube 1 dispenses adhesives through the nozzle 3 and onto the flange 7. The tube 1 is then held horizontally and the edge 9 placed on the surface to be bonded and drawn along allowing viscous liquid such as adhesive to flow along the grooves 10 and thus spread evenly onto the surface.

Figure 3:
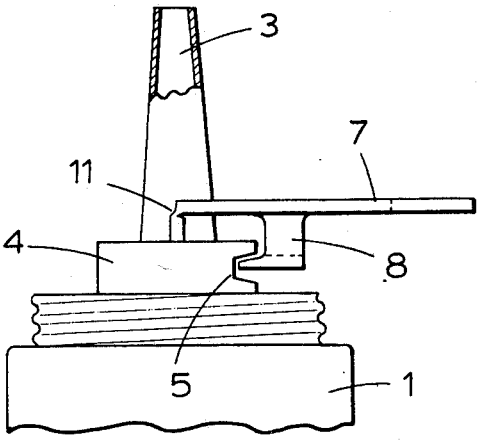
FIG. 3 represents a side elevation of the device of FIG. 1 positioned for fine point application of adhesives.
Figure 4:
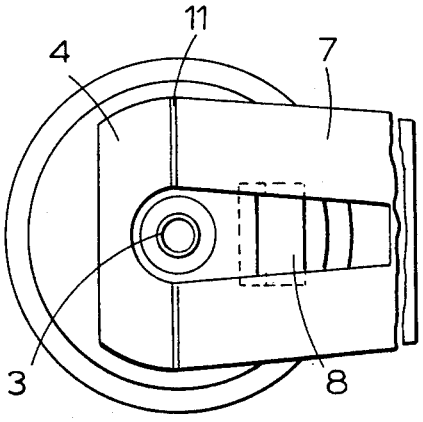
FIG. 4 represents a plan view of the device as shown in FIG. 3.

FIGS. 3 and 4 show the device positioned for its alternative mode of action, that is point application. In order to achieve this position starting from the configuration shown in FIGS. 1 and 2, the flange 7 is simply moved over the nozzle 3 (that is towards the right as depicted in FIG. 1) about the hinge 11. This action unclips the clamp 8 from the nozzle and the flange 7 is further moved until the shaped end of the clamp 8 is forced into and engaged in the recess 5 in the collar 4, thereby retaining the flange in the position shown in FIG. 3.

The end of the nozzle 3 is then free for application of viscous fluid such as adhesive directly from the nozzle to small areas.

After use, the device of this invention is returned to the position shown in FIGS. 1 and 2 and the nozzle may be sealed for example by a plug inserted into or fitted around the nozzle itself, or preferably by means of a cap which fits over the entire applicator device and screws onto the top of the flexible tube. Such a cap preferably contains an internal protuberance which, when the cap is in position on the tube, fits into or around the end of the nozzle, thereby sealing it.

The edge which is adapted to apply adhesive to a surface is provided in the above described embodiment with a number of grooves to assist the ease of spreading of adhesives. Although provision of such grooves is preferable, it is not essential and may be replaced by a single concave trough running along the edge, or merely by a straight edge itself.

In the embodiment of the invention described above, the position adjusting means for the spreader is a simple hinge. It is also possible to adapt the device so that the spreader member is slidably mounted on the nozzle, thus enabling it to be moved away from the nozzle end on an axis approximately parallel to that of the nozzle. Alternatively the applicator member may be mounted on a screw thread around the nozzle in such a way that rotation causes it to be screwed down the nozzle and clear of the nozzle end.

The spreader member itself may have a flat surface to receive viscous fluid from the nozzle, but preferably it has a groove to receive and direct the viscous fluid from the nozzle towards the edge of the water.

One advantage of the device of the invention is, as stated, its extremely simple adjustability for application either to flat surfaces or small areas. In addition the embodiment illustrated is easily cleaned of excessive adhesive when in the position shown in FIGS. 3 and 4; and furthermore, when in such a position the applicator edge may be rested on a surface and the tube is thereby supported at a convenient angle to the horizontal.

The container and device are suitable for most types of viscous fluid but is especially suitable for fluid adhesives which may be dispensed from flexible tubes, or other containers, for example adhesives designed for bonding paper, card, plastics, wood, metals etc., including all-purpose adhesieves and in particular thixotropic adhesives.

I claim:

1. An applicator for viscous fluids such as adhesives which comprises a reservoir body for holding the viscous fluid one end of which is closed and the other end of which has a top portion, an elongated discharge nozzle connected to the top portion, which nozzle communicates with the interior of the reservoir body, a collar having a recess at one portion fitted around the base of the nozzle, a spreading member pivotably mounted on the collar, the spreading member being mounted such that it is movable between an operative position adjacent the discharge nozzle and an inoperative position substantially normal to the long axis of the discharge nozzle, and means for clamping the spreading member to the nozzle in the operative position and for clamping the spreading member to the recess in the collar in a snap-lock relationship.

2. An applicator according to claim 1 wherein the spreading member is a spatulate flange.

3. An applicator according to claim 2 wherein the spatulate flange has an edge having a number of grooves thereon.

4. An applicator according to claim 2 wherein the flange has a cut-out center portion of a size such that the flange fits over the nozzle.

5. An applicator according to claim 2 wherein the spatulate flange has a straight edge at right angles to the long axis of the discharge nozzle.

6. An applicator according to claim 1 wherein the reservoir body is a collapsable tube.

7. An application according to claim 1 which further comprises a support mounted on or integral with the collar, and a hinge one portion of which is connected to the spreading member and another portion of which is connected to the support.

8. An applicator for viscous fluids such as adhesives which comprises a reservoir body for holding the viscous fluid one end of which is closed and the other end of which has a top portion, an elongated discharge nozzle connected to the top portion, which nozzle communicates with the interior of the reservoir body, a collar having a recess at one portion fitted around the base of the nozzle, a spreading member in the form of a spatulate flange having a cut-out center portion through which the nozzle extends, the flange having a straight edge at right angles to the long axis of the discharge nozzle, the spreading member being pivotably mounted on the collar such that it is movable between an operative position adjacent the discharge nozzle and an inoperative position substantially normal to the long axis of the discharge nozzle, a support mounted on or integral with the collar, a hinge one portion of which is connected to the spatulate flange and another portion of which is connected to the support, and means for clamping the spreading member to the nozzle, and for clamping the spreading member to the recess in the collar in a snap-lock relationship.

* * * * *